US010376733B2

(12) United States Patent
Mahimaidas

(10) Patent No.: US 10,376,733 B2
(45) Date of Patent: Aug. 13, 2019

(54) EXERCISE ASSEMBLY

(71) Applicant: Selva Vinothe Mahimaidas, Holliston, MA (US)

(72) Inventor: Selva Vinothe Mahimaidas, Holliston, MA (US)

( * ) Notice: Subject to any disclaimer, the term of this patent is extended or adjusted under 35 U.S.C. 154(b) by 121 days.

(21) Appl. No.: 15/792,005

(22) Filed: Oct. 24, 2017

(65) Prior Publication Data

US 2019/0118023 A1 Apr. 25, 2019

(51) Int. Cl.
*A63B 21/00* (2006.01)
*A63B 21/04* (2006.01)

(52) U.S. Cl.
CPC ..... *A63B 21/0407* (2013.01); *A63B 21/151* (2013.01); *A63B 21/4034* (2015.10); *A63B 21/4035* (2015.10); *A63B 21/4045* (2015.10); *A63B 2208/0228* (2013.01); *A63B 2209/10* (2013.01); *A63B 2225/09* (2013.01)

(58) Field of Classification Search
CPC ..... A63B 21/4045; A63B 21/4034; A63B 21/4035; A63B 21/151; A63B 2208/0228; A63B 2225/09; A63B 2209/10; A63B 21/00; A63B 21/0004; A63B 21/00043; A63B 21/02; A63B 21/0407–21/0557; A63B 21/00061
See application file for complete search history.

(56) References Cited

U.S. PATENT DOCUMENTS 1,750,549 A * 3/1930 Thomson ..... A63B 22/0076 482/130
3,749,400 A * 7/1973 Stoffel ..... A63B 21/023 273/DIG. 5
4,111,417 A * 9/1978 Gardner ..... A63B 21/05 482/128
4,886,050 A 12/1989 Iams et al.
5,007,632 A * 4/1991 Wilkinson ..... A63B 21/04 482/130
5,203,751 A * 4/1993 Chang ..... A63B 22/0002 482/51
5,295,935 A * 3/1994 Wang ..... A63B 21/0552 482/123
5,518,483 A * 5/1996 Oswald ..... A63B 21/012 482/114
5,997,448 A * 12/1999 Duba ..... A63B 21/0552 482/121
D419,625 S 1/2000 Barnett et al.
6,071,217 A * 6/2000 Barnett ..... A63B 21/0552 482/121

(Continued)

*Primary Examiner* — Andrew S Lo

(57) ABSTRACT

An exercise assembly for resistance exercises includes a base that is configured to position on a horizontal surface. A post is coupled to and extends perpendicularly from the base. A beam is rotationally coupled to and extends bidirectionally from the post. A first plate is coupled to and centrally positioned above the post. The first plate is padded and configured to seat a user. Each of a pair of rods is slidably coupled to and extends bidirectionally from the beam between the first plate and a respective opposing end of the beam. The rods are configured to selectively couple to the hands and feet of the user. A plurality of bands, which is resilient, is selectively couplable to and extends between the rods and the first plate. The bands are configured to selectively resist movement of the rods along the beam.

20 Claims, 6 Drawing Sheets

(56) References Cited

U.S. PATENT DOCUMENTS 6,569,064 B1 * 5/2003 Loane ..... A63B 21/154 482/146
6,942,605 B1 9/2005 Sukhovitsky
7,125,367 B1 * 10/2006 Stearns ..... A63B 22/203 482/141
7,294,100 B2 * 11/2007 Bull ..... A63B 23/03541 482/51
7,641,603 B2 * 1/2010 Lacher ..... A63B 22/0076 482/134
7,722,512 B2 * 5/2010 Liang ..... A63B 21/154 482/130
7,780,585 B1 8/2010 Rivas
7,850,578 B2 * 12/2010 Balaker ..... A63B 21/156 482/131
7,931,570 B2 * 4/2011 Hoffman ..... A63B 21/055 482/123
7,955,233 B1 * 6/2011 Wu ..... A63B 21/018 482/101
7,981,005 B1 * 7/2011 Tsai ..... A63B 21/055 482/147
8,100,815 B2 * 1/2012 Balaker ..... A63B 21/156 482/131
8,888,661 B2 11/2014 Ellis
9,700,757 B2 * 7/2017 Shade ..... A63B 23/1236
2005/0096194 A1 * 5/2005 Bond ..... A63B 21/055 482/92
2005/0227836 A1 * 10/2005 Wen ..... A63B 21/068 482/141
2005/0250628 A1 * 11/2005 Goldstein ..... A63B 21/0552 482/141
2006/0183606 A1 * 8/2006 Parmater ..... A63B 22/0076 482/72
2008/0070766 A1 * 3/2008 Brown ..... A63B 21/068 482/140
2011/0039667 A1 * 2/2011 Teng ..... A63B 23/03541 482/142
2012/0035028 A1 * 2/2012 Ahmadi Mirghaed ..... A61H 1/0244 482/129
2012/0277079 A1 * 11/2012 Allain ..... A63B 21/023 482/142
2013/0095986 A1 * 4/2013 Yarvitz ..... A63B 21/00 482/139
2013/0217551 A1 * 8/2013 Parnell ..... A63B 21/0442 482/141
2013/0337982 A1 * 12/2013 Williams ..... A63B 21/02 482/122
2015/0065320 A1 * 3/2015 Anderson ..... A63B 21/0428 482/142
2015/0151158 A1 6/2015 Ellis
2015/0217160 A1 * 8/2015 Boykin ..... A63B 23/0211 482/123
2015/0367173 A1 12/2015 Ellis
2017/0144009 A1 * 5/2017 Pearce ..... A63B 21/0428

* cited by examiner

EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including information disclosed under 37 CFR 1.97 and 1.98

The disclosure and prior art relates to exercise assemblies and more particularly pertains to a new exercise assembly for resistance exercises.

BRIEF SUMMARY OF THE INVENTION

An embodiment of the disclosure meets the needs presented above by generally comprising a base that is configured to position on a horizontal surface. A post is coupled to and extends perpendicularly from the base. A beam is rotationally coupled to and extends bidirectionally from the post. A first plate is coupled to and centrally positioned above the post. The first plate is padded and configured to seat a user. Each of a pair of rods is slidably coupled to and extends bidirectionally from the beam between the first plate and a respective opposing end of the beam. The rods are configured to selectively couple to the hands and feet of the user. A plurality of bands, which is resilient, is selectively couplable to and extends between the rods and the first plate. The bands are configured to selectively resist movement of the rods along the beam.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
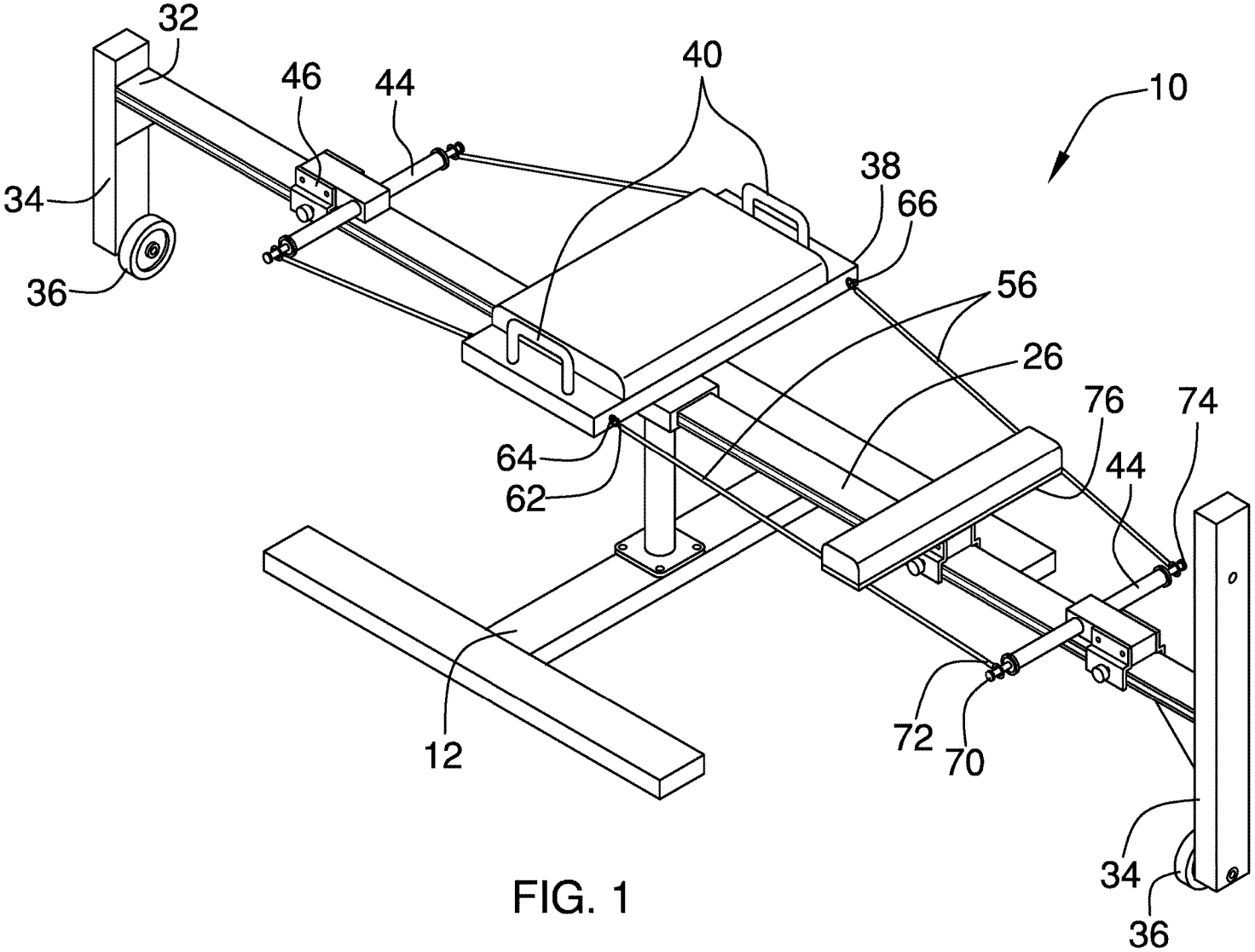
FIG. 1 is an isometric perspective view of an exercise assembly according to an embodiment of the disclosure.
Figure 2:
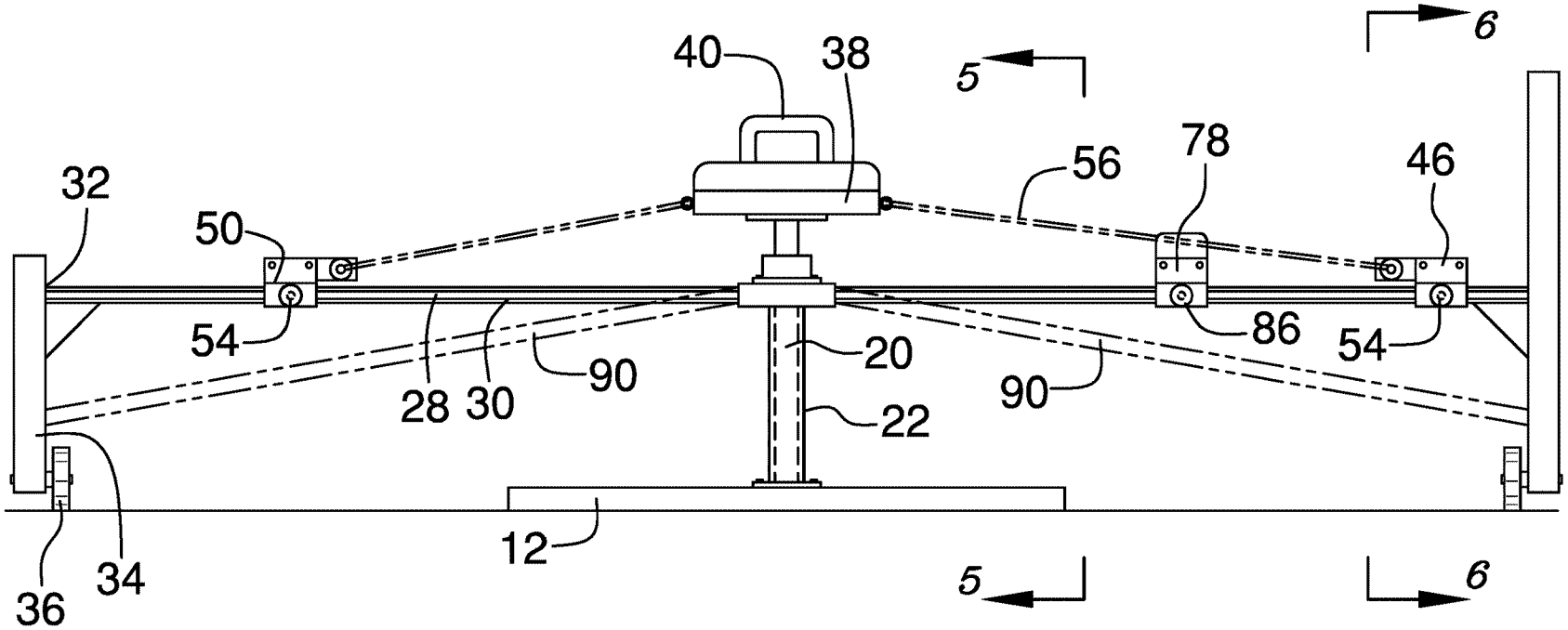
FIG. 2 is a side view of an embodiment of the disclosure.
Figure 3:
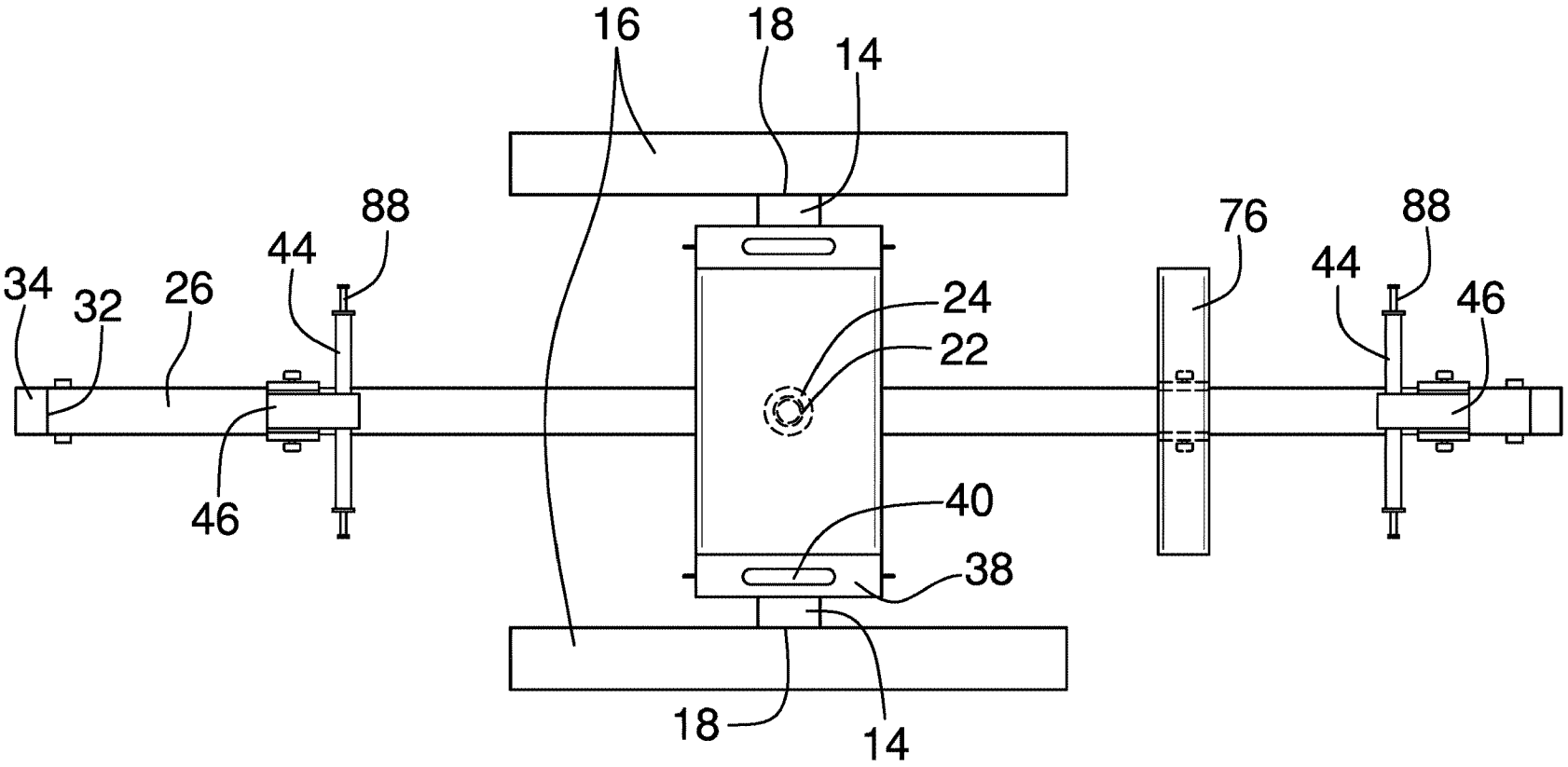
FIG. 3 is a top view of an embodiment of the disclosure.
Figure 4:
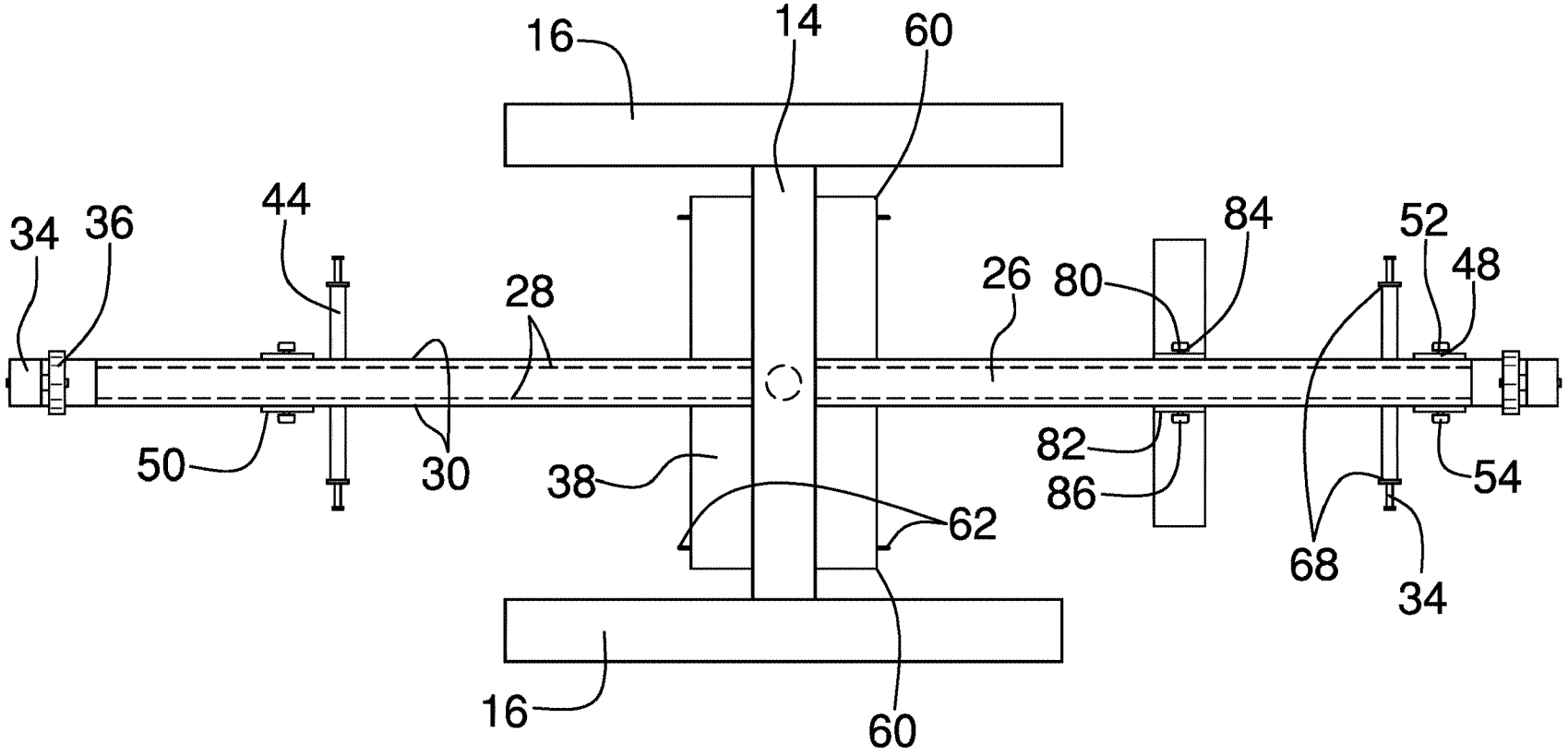
FIG. 4 is a bottom view of an embodiment of the disclosure.
Figure 5:
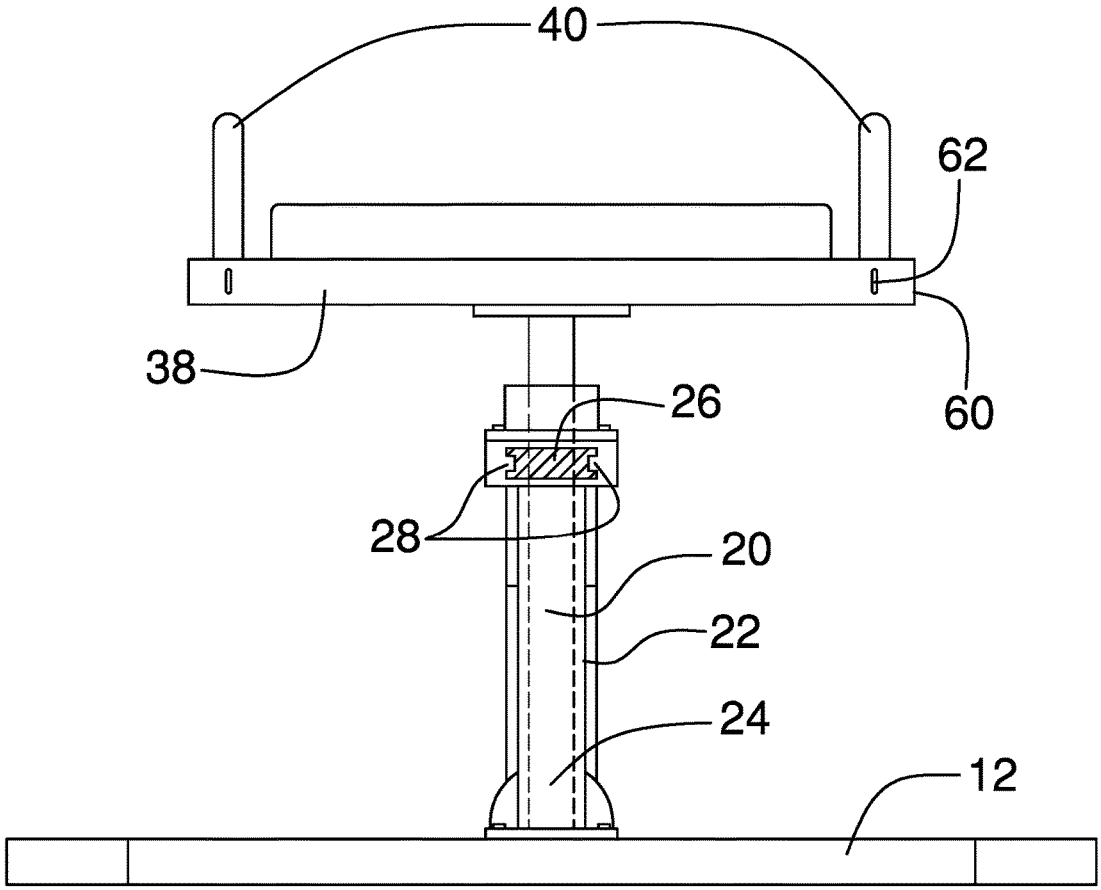
FIG. 5 is a cross-sectional view of an embodiment of the disclosure.
Figure 6:
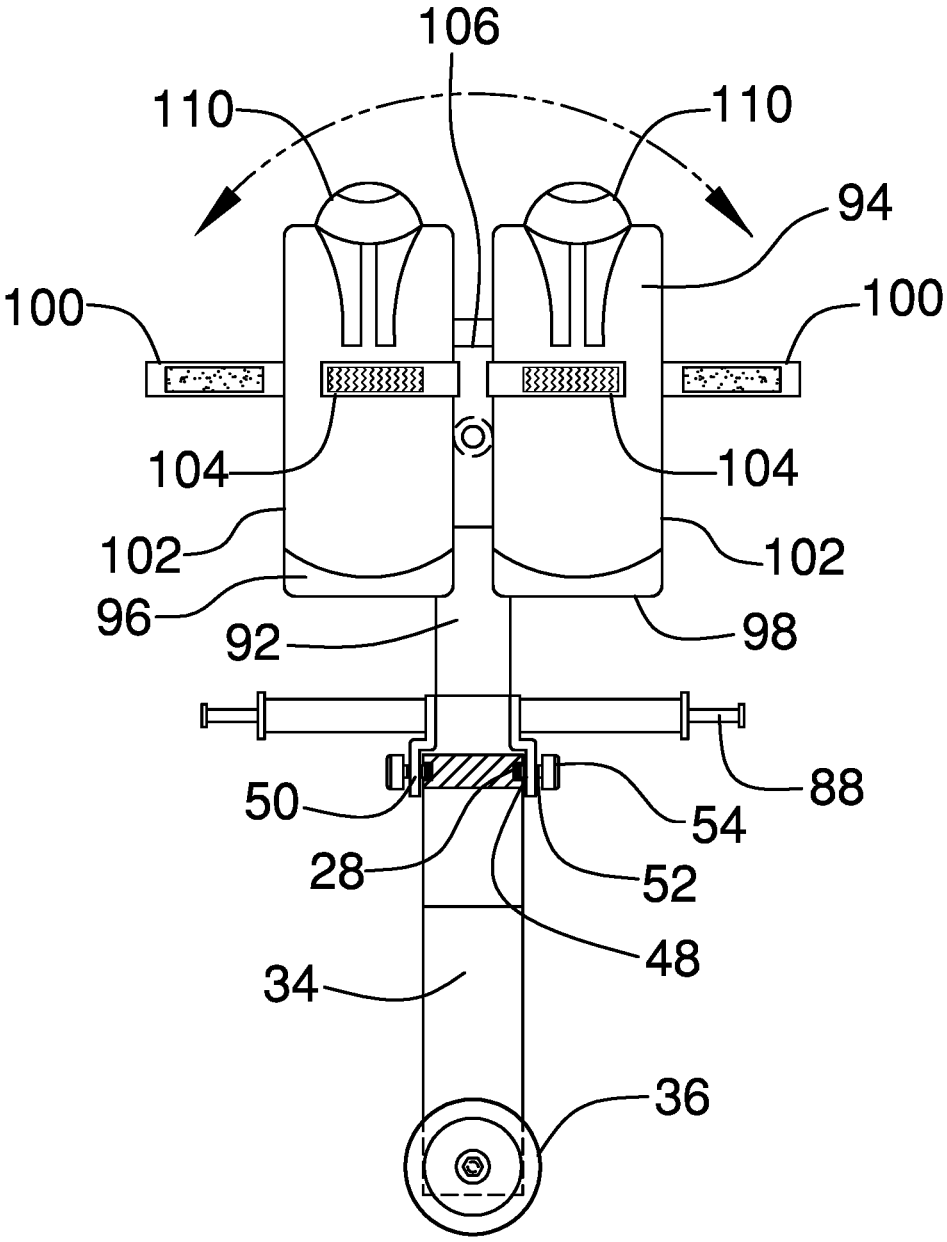
FIG. 6 is a detail view of an embodiment of the disclosure.

With reference now to the drawings, and in particular to FIGS. 1 through 6 thereof, a new exercise assembly embodying the principles and concepts of an embodiment of the disclosure and generally designated by the reference numeral 10 will be described.

As best illustrated in FIGS. 1 through 6, the exercise assembly 10 generally comprises a base 12 that is configured to position on a horizontal surface. In one embodiment, the base 12 comprises a first plank 14 and a pair of second planks 16. Each second plank 16 is coupled to extends bidirectionally from a respective opposing endpoint 18 of the first plank 14.

A post 20 is coupled to and extends perpendicularly from the base 12. The post 20 is centrally positioned on the base 12. In one embodiment, the post 20 is circularly shaped when viewed longitudinally.

In one embodiment, a pipe 22 is coupled to and extends perpendicularly from the base 12. The pipe 22 is centrally positioned on the base 12. The pipe 22 is circularly shaped when viewed longitudinally. The post 20 is positioned through the pipe 22. At least one bearing 24 is positioned in the pipe 22. The at least one bearing 24 is positioned to rotationally couple the pipe 22 to the base 12.

A beam 26 is rotationally coupled to and extends bidirectionally from the post 20 distal from the base 12. Each of a pair of channels 28 is positioned in a respective opposing side 30 of the beam 26. The channels 28 extend substantially between opposing ends 32 of the beam 26. In one embodiment, the beam 26 comprises a pair of beams 90 that is coupled to and extends bidirectionally from the pipe 22. Each beam 90 is hingedly coupled to the pipe 22 so that the beams 90 are selectively angularly positionable relative to the post 20.

Each of a pair of bars 34 is coupled to and extends perpendicularly from a respective opposing end 32 of the beam 26. Each of a pair of wheels 36 is axially coupled to a respective bar 34 distal from the beam 26. The wheels 36 are configured to roll on the horizonal surface coincident with the beam 26. The bars 34 and the wheels 36 are positioned to support the beam 26 upon the horizontal surface as the beam 26 is rotated relative to the base 12. In one embodiment, each of the pair of beams 90 is selectively couplable to a respective bar 34 so that the beams 90 are selectively angularly positionable relative to the post 20.

A first plate 38 is coupled to the post 20 above the beam 26. The first plate 38 is centrally positioned above the post 20. The first plate 38 is padded. The first plate 38 is configured to seat a user. In one embodiment, the first plate 38 is substantially rectangularly shaped.

Each of a pair of handles 40 is coupled to and extends perpendicularly from a respective opposing edge 42 of the first plate 38. Each handle 40 is configured to be grasped in a respective hand of the user. In one embodiment, the handles 40 are substantially C-shaped.

Each of a pair of rods 44 is slidably coupled to and extends bidirectionally from the beam 26. Each rod 44 is positioned between the first plate 38 and a respective opposing end 32 of the beam 26. The rods 44 are configured to selectively couple to the hands and feet of the user. In one embodiment, the rods 44 are circularly shaped when viewed longitudinally. In another embodiment, the rods 44 are padded.

Each of a pair of first brackets 46 is slidably coupled to the beam 26 and is rotationally coupled to a respective rod 44. The first brackets 46 are configured to couple to the beam 26. The first brackets 46 are positioned to selectively slide along the beam 26 and to couple to the beam 26 to fixedly position the rods 44 relative to the first plate 38.

In one embodiment, a third plate 92 is coupled to and extends upwardly from a respective first bracket 46. A fourth plate 94 is rotationally coupled to the third plate 92. The fourth plate 94 is configured to selectively couple to the feet of the user. In another embodiment, a lip 96 is coupled to and extends from a rim 98 of the fourth plate 94. The lip 96 is configured to position heels of the feet of the user. Each of a pair of first fasteners 100 is coupled to and extends from a respective opposing side edge 102 of the fourth plate 94. A pair of second fasteners 104 is coupled to and extends from a midline 106 of the fourth plate 94. The second fasteners 104 are complementary to the first fasteners 100. Each first fastener 100 and an associated second fastener 104 are configured to loopedly position around a respective foot so that that the first fastener 100 is positioned to couple to the associated second fastener 104 to couple the respective foot to the fourth plate 94. In yet another embodiment, each first fastener 100 and the associated second fastener 104 comprise a hook and loop strap fastener 108. A pair of cups 110 is coupled to and extends from the rim 98 of the fourth plate 94. The cups 110 are opposingly positioned relative to the lip 96. Each cup 110 is configured to insert a toe end of a respective foot of the user.

In one embodiment, each of a set of four first holes 48 is positioned in a respective opposing face 50 of a respective first bracket 46. The first holes 48 are threaded. In this embodiment, the assembly 10 comprises a set of four first bolts 52. The first bolts 52 are complementary to the first holes 48. Each first hole 48 is positioned to threadedly insert a respective first bolt 52 into an associated channel 28 to couple the first bracket 46 to the beam 26. In another embodiment, each of a set of four first knobs 54 is coupled to a respective first bolt 52. Each first knob 54 is configured to be grasped in digits of the hand of the user to rotate a respective first bolt 52 within an associated first hole 48.

A plurality of bands 56 is selectively couplable to and extends between the pair of rods 44 and the first plate 38. The bands 56 are resilient. The bands 56 are configured to selectively resist movement of the rods 44 along the beam 26. In one embodiment, the plurality of bands 56 comprises four bands 56 that extend singly between an opposing terminus 58 of a respective rod 44 and an associated corner 60 of the first plate 38.

In one embodiment, each of a set of four first couplers 62 is coupled to the first plate 38 proximate to a respective corner 60 of the first plate 38. In this embodiment, each of a set of four second couplers 64, which is complementary to the first couplers 62 is coupled to a first termination 66 of a respective band 56. Each second coupler 64 is positioned to couple to a respective first coupler 62 to couple a respective band 56 to the first plate 38. Also in this embodiment, each of a set of four first connectors 68 is coupled to a respective rod 44 proximate to a respective opposing terminus 58 of the respective rod 44. Each of a set of four second connectors 70 is coupled to a second termination 72 of the respective band 56. The second connectors 70 are complementary to the first connectors 68. Each second connector 70 is positioned to couple to a respective first connector 68 to couple a respective band 56 to the respective rod 44. In another embodiment, each first connector 68 comprises a pin 88 that is coupled to and extends axially from the opposing terminus 58 of the respective rod 44. In this embodiment, each second connector 70 comprises a ring 74.

A second plate 76 is slidably coupled to and extends bidirectionally from the beam 26. The second plate 76 is positioned between the first plate 38 and a respective rod 44. The second plate 76 is padded. The second plate 76 is configured to engage the knees of the user.

A second bracket 78 is slidably coupled to the beam 26. The second bracket 78 is coupled to the second plate 76. The second bracket 78 also is configured to couple to the beam 26. The second bracket 78 is positioned to selectively slide along the beam 26 and to couple to the beam 26 to fixedly position the second plate 76 relative to the first plate 38.

In one embodiment, each of a pair second holes 80 is positioned in a respective opposing side face 82 of the second bracket 78. The second holes 80 are threaded. In this embodiment, the assembly 10 comprises a pair of second bolts 84. The second bolts 84 are complementary to the second holes 80. Each second hole 80 is positioned to threadedly insert a respective second bolt 84 into an associated channel 28 to couple the second bracket 78 to the beam 26. In another embodiment, each of a pair of second knobs 86 is coupled to a respective second bolt 84. Each second knob 86 is configured to be grasped in the digits of the hand of the user to rotate a respective second bolt 84 within an associated second hole 80.

In use, the at least one bearing 24 is positioned to rotationally couple the pipe 22 to the base 12. The wheels 36 are configured to roll on the horizonal surface coincident with the beam 26. The bars 34 and the wheels 36 are positioned to support the beam 26 upon the horizontal surface as the beam 26 is rotated relative to the base 12. The first plate 38 is configured to seat the user. Each handle 40 is configured to be grasped in the respective hand of the user. The first brackets 46 are positioned to selectively slide along the beam 26 and to couple to the beam 26 to fixedly position the rods 44 relative to the first plate 38. The rods 44 are configured to selectively couple to the hands and feet of the user. Each second coupler 64 is positioned to couple to the respective first coupler 62 to couple the respective band 56 to the first plate 38. Each second connector 70 is positioned to couple to the respective first connector 68 to couple the respective band 56 to the respective rod 44. The bands 56 are configured to selectively resist movement of the rods 44 along the beam 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise assembly comprising:

a base configured for positioning on a horizontal surface;

a post coupled to and extending perpendicularly from said base;

a beam rotationally coupled to and extending bidirectionally from said post distal from said base;

a first plate coupled to said post, said post being centrally positioned on said first plate, said first plate being padded;

a pair of rods slidably coupled to and extending bidirectionally from said beam, each said rod being positioned between said first plate and a respective opposing end of said beam;

a plurality of bands selectively couplable to and extending between said pair of rods and said first plate, said bands being resilient; and wherein said first plate is positioned on said beam such that said first plate is configured for seating a user, wherein said rods are positioned on said beam such that said rods are configured for selectively coupling to the hands and feet of the user, wherein said bands are positioned on said rods and said first plate such that said bands are configured for selectively resisting movement of said rods along said beam.

2. The assembly of claim 1, further including said base comprising a first plank and a pair of second planks, each said second plank being coupled to extending bidirectionally from a respective opposing endpoint of said first plank.

3. The assembly of claim 1, further including said post being centrally positioned on said base, said post being circularly shaped when viewed longitudinally.

4. The assembly of claim 3, further comprising:

a pipe coupled to and extending perpendicularly from said base, said pipe being centrally positioned on said base, said pipe being circularly shaped when viewed longitudinally, said post being positioned through said pipe;

at least one bearing positioned in said pipe; and wherein said at least one bearing is positioned in said pipe such that said at least one bearing is positioned for rotationally coupling said pipe to said base.

5. The assembly of claim 4, further comprising:

a pair of bars, each said bar being coupled to and extending perpendicularly from a respective said opposing end of said beam;

a pair of wheels, each said wheel being axially coupled to a respective said bar distal from said beam positioning said wheels for rolling on the horizontal surface; and wherein said wheels are positioned on said bars such that said wheels are configured for rolling on the horizonal surface coincident with said beam such that said bars and said wheels are positioned for supporting said beam upon the horizontal surface as said beam is rotated relative to said base.

6. The assembly of claim 5, further including said beam comprising a pair of beams coupled to extending bidirectionally from said pipe, each of said pair of beams being hingedly coupled to said pipe, each of said pair of beams being selectively couplable to a respective said bar such that said beams are selectively angularly positionable relative to said post.

7. The assembly of claim 1, further including said first plate being substantially rectangularly shaped.

8. The assembly of claim 1, further including a pair of handles, each said handle being coupled to and extending perpendicularly from a respective opposing edge of said first plate, wherein said handles are positioned on said first plate such that each said handle is configured for grasping in a respective hand of the user.

9. The assembly of claim 8, further including said handles being substantially C-shaped.

10. The assembly of claim 1, further including said rods being circularly shaped when viewed longitudinally, said rods being padded.

11. The assembly of claim 1, further including a pair of first brackets, each said first bracket being slidably coupled to said beam and rotationally coupled to a respective rod, said first brackets being configured for coupling to said beam, wherein said first brackets are positioned on said beam such that said first brackets are positioned for selectively sliding along said beam and for coupling to said beam for fixedly positioning said rods relative to said first plate.

12. The assembly of claim 11, further comprising:

a pair of channels, each said channel being positioned in a respective opposing side of said beam, said channels extending substantially between opposing ends of said beam;

a set of four first holes, said first holes being threaded, each said first hole being positioned in a respective opposing face of a respective said first bracket;

a set of four first bolts, said first bolts being complementary to said first holes; and wherein said first holes are positioned through said first brackets such that each said first hole is positioned for threadedly inserting a respective said first bolt into an associated said channel for coupling said first bracket to said beam.

13. The assembly of claim 12, further including a set of four first knobs, each said first knob being coupled to a respective said first bolt, wherein said first knobs are positioned on said first bolts such that each said first knob is configured for grasping in digits of the hand of the user for rotating a respective said first bolt within an associated said first hole.

14. The assembly of claim 11, further comprising:

a third plate coupled to and extending upwardly from a respective said first bracket;

a fourth plate rotationally coupled to said third plate, said fourth plate being configured to selectively couple to the feet of the user;

a lip coupled to and extending from a rim of said fourth plate such that said lip is configured to position heels of the feet of the user;

a pair of first fasteners, each said first fastener being coupled to and extending from a respective opposing side edge of said fourth plate;

a pair of second fasteners, each said second fastener being coupled to and extending from a midline of said fourth plate, said second fasteners being complementary to said first fasteners, each said first fastener and an associated said second fastener being configured to loopedly position around a respective foot such that said first fastener is positioned for coupling to said associated said second fastener for coupling the respective foot to said fourth plate, each said first fastener and said associated said second fastener comprising a hook and loop strap fastener; and a pair of cups coupled to and extending from an opposing rim of said fourth plate, said cups being opposingly positioned relative to said lip, each said cup being configured for inserting a toe end of a respective foot of the user.

15. The assembly of claim 1, further including a second plate slidably coupled to and extending bidirectionally from said beam, said second plate being positioned between said first plate and a respective said rod, said second plate being padded, wherein said second plate is positioned on said beam such that said second plate is configured for engaging the knees of the user.

16. The assembly of claim 15, further including a second bracket slidably coupled to said beam, said second bracket being coupled to said second plate, said second bracket being configured for coupling to said beam, wherein said second bracket is positioned on said beam such that said second bracket is positioned for selectively sliding along said beam and for coupling to said beam for fixedly positioning said second plate relative to said first plate.

17. The assembly of claim 16, further comprising:

a pair of channels, each said channel being positioned in a respective opposing side of said beam, said channels extending substantially between opposing ends of said beam;

a pair second holes, said second holes being threaded, each said second hole being positioned in a respective opposing side face of a said second bracket;

a pair of second bolts, said second bolts being complementary to said second holes;

a pair of second knobs, each said second knob being coupled to a respective said second bolt;

and wherein said second knobs are positioned on said second bolts such that each said second knob is configured for grasping in the digits of the hand of the user for rotating a respective said second bolt within an associated said second hole, wherein said second holes are positioned through said second bracket such that each said second hole is positioned for threadedly inserting a respective said second bolt into an associated said channel for coupling said second bracket to said beam.

18. The assembly of claim 1, further including said plurality of bands comprising four said bands extending singly between an opposing terminus of a respective said rod and an associated corner of said first plate.

19. The assembly of claim 18, further comprising:

a set of four first couplers, each said first coupler being coupled to said first plate proximate to a respective said corner of said first plate;

a set of four second couplers, said second couplers being complementary to said first couplers, each said second coupler being coupled to a first termination of a respective said band;

a set of four first connectors, each said first connector being coupled to a respective said rod proximate to a respective said opposing terminus of said respective said rod, each said first connector comprising a pin coupled to and extending axially from said opposing terminus of said respective said rod;

a set of four second connectors, said second connectors being complementary to said first connectors, each said second connector being coupled to a second termination of said respective said band, each said second connector comprising a ring; and wherein said second couplers are positioned on said bands such that each said second coupler is positioned for coupling to a respective said first coupler for coupling a respective said band to said first plate, wherein said second connectors are positioned on said bands such that each said second connector is positioned for coupling to a respective said first connector for coupling a respective said band to said respective said rod.

20. An exercise assembly comprising:

a base configured for positioning on a horizontal surface, said base comprising a first plank and a pair of second planks, each said second plank being coupled to extending bidirectionally from a respective opposing endpoint of said first plank;

a post rotationally coupled to and extending perpendicularly from said base, said post being centrally positioned on said base, said post being circularly shaped when viewed longitudinally;

a pipe coupled to and extending perpendicularly from said base, said pipe being centrally positioned on said base, said pipe being circularly shaped when viewed longitudinally, said post being positioned through said pipe;

at least one bearing positioned in said pipe, wherein said at least one bearing is positioned in said pipe such that said at least one bearing is positioned for rotationally coupling said pipe to said base;

a beam coupled to and extending bidirectionally from said post distal from said base, said beam comprising a pair of beams coupled to extending bidirectionally from said pipe, each of said pair of beams being hingedly coupled to said pipe;

a pair of channels, each said channel being positioned in a respective opposing side of said beam, said channels extending substantially between opposing ends of said beam;

a pair of bars, each said bar being coupled to and extending perpendicularly from a respective opposing end of said beam, each of said pair of beams being selectively couplable to a respective said bar such that said beams are selectively angularly positionable relative to said post;

a pair of wheels, each said wheel being axially coupled to a respective said bar distal from said beam positioning said wheels for rolling on the horizontal surface, wherein said wheels are positioned on said bars such that said wheels are configured for rolling on the horizonal surface coincident with said beam such that said bars and said wheels are positioned for supporting said beam upon the horizontal surface as said beam is rotated relative to said base;

a first plate coupled to said post, said post being centrally positioned on said first plate, said first plate being padded, wherein said first plate is positioned on said beam such that said first plate is configured for seating a user, said first plate being substantially rectangularly shaped;

a pair of handles, each said handle being coupled to and extending perpendicularly from a respective opposing edge of said first plate, wherein said handles are positioned on said first plate such that each said handle is configured for grasping in a respective hand of the user, said handles being substantially C-shaped;

a pair of rods slidably coupled to and extending bidirectionally from said beam, each said rod being positioned between said first plate and a respective said opposing end of said beam, wherein said rods are positioned on said beam such that said rods are configured for selectively coupling to the hands and feet of the user, said rods being circularly shaped when viewed longitudinally, said rods being padded;

a pair of first brackets, each said first bracket being slidably coupled to said beam and rotationally coupled to a respective rod, said first brackets being configured for coupling to said beam, wherein said first brackets are positioned on said beam such that said first brackets are positioned for selectively sliding along said beam and for coupling to said beam for fixedly positioning said rods relative to said first plate;

a set of four first holes, said first holes being threaded, each said first hole being positioned in a respective opposing face of a respective said first bracket;

a set of four first bolts, said first bolts being complementary to said first holes, wherein said first holes are positioned through said first brackets such that each said first hole is positioned for threadedly inserting a respective said first bolt into an associated said channel for coupling said first bracket to said beam;

a set of four first knobs, each said first knob being coupled to a respective said first bolt, wherein said first knobs are positioned on said first bolts such that each said first knob is configured for grasping in digits of the hand of the user for rotating a respective said first bolt within an associated said first hole;

a plurality of bands selectively couplable to and extending between said pair of rods and said first plate, said bands being resilient, wherein said bands are positioned on said rods and said first plate such that said bands are configured for selectively resisting movement of said rods along said beam, said plurality of bands comprising four said bands extending singly between an opposing terminus of a respective said rod and an associated corner of said first plate;

a set of four first couplers, each said first coupler being coupled to said first plate proximate to a respective said corner of said first plate;

a set of four second couplers, said second couplers being complementary to said first couplers, each said second coupler being coupled to a first termination of a respective said band, wherein said second couplers are positioned on said bands such that each said second coupler is positioned for coupling to a respective said first coupler for coupling a respective said band to said first plate;

a set of four first connectors, each said first connector being coupled to a respective said rod proximate to a respective said opposing terminus of said respective said rod, each said first connector comprising a pin coupled to and extending axially from said opposing terminus of said respective said rod;

a set of four second connectors, said second connectors being complementary to said first connectors, each said second connector being coupled to a second termination of said respective said band, wherein said second connectors are positioned on said bands such that each said second connector is positioned for coupling to a respective said first connector for coupling a respective said band to said respective said rod, each said second connector comprising a ring;

a second plate slidably coupled to and extending bidirectionally from said beam, said second plate being positioned between said first plate and a respective said rod, said second plate being padded, wherein said second plate is positioned on said beam such that said second plate is configured for engaging the knees of the user;

a third plate coupled to and extending upwardly from a respective said first bracket;

a fourth plate rotationally coupled to said third plate, said fourth plate being configured to selectively couple to the feet of the user;

a lip coupled to and extending from a rim of said fourth plate such that said lip is configured to position heels of the feet of the user;

a pair of first fasteners, each said first fastener being coupled to and extending from a respective opposing side edge of said fourth plate;

a pair of second fasteners, each said second fastener being coupled to and extending from a midline of said fourth plate, said second fasteners being complementary to said first fasteners, each said first fastener and an associated said second fastener being configured to loopedly position around a respective foot such that said first fastener is positioned for coupling to said associated said second fastener for coupling the respective foot to said fourth plate, each said first fastener and said associated said second fastener comprising a hook and loop strap fastener;

a pair of cups coupled to and extending from an opposing rim of said fourth plate, said cups being opposingly positioned relative to said lip, each said cup being configured for inserting a toe end of a respective foot of the user;

a second bracket slidably coupled to said beam, said second bracket being coupled to said second plate, said second bracket being configured for coupling to said beam, wherein said second bracket is positioned on said beam such that said second bracket is positioned for selectively sliding along said beam and for coupling to said beam for fixedly positioning said second plate relative to said first plate;

a pair second holes, said second holes being threaded, each said second hole being positioned in a respective opposing side face of a said second bracket;

a pair of second bolts, said second bolts being complementary to said second holes, wherein said second holes are positioned through said second bracket such that each said second hole is positioned for threadedly inserting a respective said second bolt into an associated said channel for coupling said second bracket to said beam;

a pair of second knobs, each said second knob being coupled to a respective said second bolt, wherein said second knobs are positioned on said second bolts such that each said second knob is configured for grasping in the digits of the hand of the user for rotating a respective said second bolt within an associated said second hole; and wherein said at least one bearing is positioned in said pipe such that said at least one bearing is positioned for rotationally coupling said pipe to said post, wherein said wheels are positioned on said bars such that said wheels are configured for rolling on the horizonal surface coincident with said beam such that said bars and said wheels are positioned for supporting said beam upon the horizontal surface as said beam is rotated relative to said base, wherein said first plate is positioned on said beam such that said first plate is configured for seating the user, wherein said handles are positioned on said first plate such that each said handle is configured for grasping in the respective hand of the user, wherein said first brackets are positioned on said beam such that said first brackets are positioned for selectively sliding along said beam and for coupling to said beam for fixedly positioning said rods relative to said first plate, wherein said rods are positioned on said beam such that said rods are configured for selectively coupling to the hands and feet of the user, wherein said second couplers are positioned on said bands such that each said second coupler is positioned for coupling to said respective said first coupler for coupling said respective said band to said first plate, wherein said second connectors are positioned on said bands such that each said second connector is positioned for coupling to said respective said first connector for coupling said respective said band to said respective said rod such that said bands are configured for selectively resisting movement of said rods along said beam.

* * * * *